US006446293B2

(12) United States Patent
Lindquist et al.

(10) Patent No.: US 6,446,293 B2
(45) Date of Patent: Sep. 10, 2002

(54) VACUUM CLEANER THAT CHARGES A DUSTER WITH STATIC ELECTRICITY

(75) Inventors: Tommy Lindquist, Farsta; Curt Nyberg, Tyresö ; Johann Zita, Stockholm, all of (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/728,008

(22) Filed: Dec. 1, 2000

(30) Foreign Application Priority Data

Dec. 3, 1999 (SE) ..... 9904400

(51) Int. Cl.[7] ..... A47L 9/00
(52) U.S. Cl. ..... 15/1.52; 15/246.2
(58) Field of Search ..... 15/1.52, 1.51, 15/246.2, DIG. 9, 310

(56) References Cited

U.S. PATENT DOCUMENTS 1,637,067 A * 7/1927 Wieckhorst ..... 15/142
1,785,873 A 12/1930 Muller ..... 15/246
1,835,511 A * 12/1931 Means ..... 141/314
1,995,443 A * 3/1935 Baker ..... 15/142
2,219,911 A * 10/1940 Wells ..... 15/310
2,240,107 A * 4/1941 Wells ..... 15/142
2,304,193 A * 12/1942 Nielsen ..... 15/257.01
2,437,340 A * 3/1948 Zugehoer ..... 15/142
2,623,230 A * 12/1952 Feinen ..... 15/142
5,400,465 A * 3/1995 Bosses et al. ..... 15/339

FOREIGN PATENT DOCUMENTS

DE 1 900 890 8/1970

* cited by examiner

*Primary Examiner*—Theresa T. Snider
(74) *Attorney, Agent, or Firm*—Pearne & Gordon LLP

(57) ABSTRACT

A device for a vacuum cleaner that has a vacuum source (12) connected to an inlet channel, and an outlet channel for air flowing through the vacuum cleaner. The vacuum cleaner includes a device for electrostatically charging a feather-duster (20) or a micro fiber type with static electricity.

13 Claims, 1 Drawing Sheet

VACUUM CLEANER THAT CHARGES A DUSTER WITH STATIC ELECTRICITY

BACKGROUND OF THE INVENTION

1. Field of the Invention

The present invention relates to a device for a vacuum cleaner having a vacuum source that is connected to an inlet channel and an outlet channel for air flowing through the vacuum cleaner.

2. Description of Related Art

Vacuum cleaners are used to remove dust and dirt particles from floors by means of conventional floor nozzles. Different accessories are also know for removing dust and dirt from furniture, shelves and other types of objects. These accessories usually include a brush nozzle that is placed on the vacuum cleaner tube handle. The tube handle is, via a flexible hose, connected to the vacuum cleaner housing. This brush nozzle is however, together with the associated hose and tube handle, often regarded as too cumbersome and indelicate to be used for cleaning of shelves and other surfaces on which fragile objects are tightly stored. Instead, dusters or feather-dusters are used for cleaning such surfaces.

Feather-duster have the advantage that they have many light and flexible thread and/or fiber shaped elements that bend away when touching the objects such that the feather-duster can reach in between and more or less surround the objects being cleaned. The feather-dusters and some dusters, so called micro fiber dusters, are designed such that they are charged with static electricity when being used. This means that dust particles, when being removed from the surface, adhere to the feather-duster or the micro fiber duster. However, a disadvantage with this type of feather-dusters or micro fiber dusters is that the electrostatic charge is not sufficiently large to achieve an effective dust removal. A further disadvantage with feather-dusters as well as with all kind of dusters is that the operator frequently has to go to a space where the feather-duster or the duster can be shaken such that the dust which is stuck on the duster is loosened.

SUMMARY OF THE INVENTION

The present invention is directed toward a system for using a feather-duster or a micro fiber duster together with the vacuum cleaner wherein the feather-duster or the duster is, in a simple way, charged electrostatically in order to improve the capacity of removing dust from objects at the same time as the feather-duster or duster is cleaned. According to the present invention, the two stages, vacuum cleaning and dusting, are integrated into a combined rational operation.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
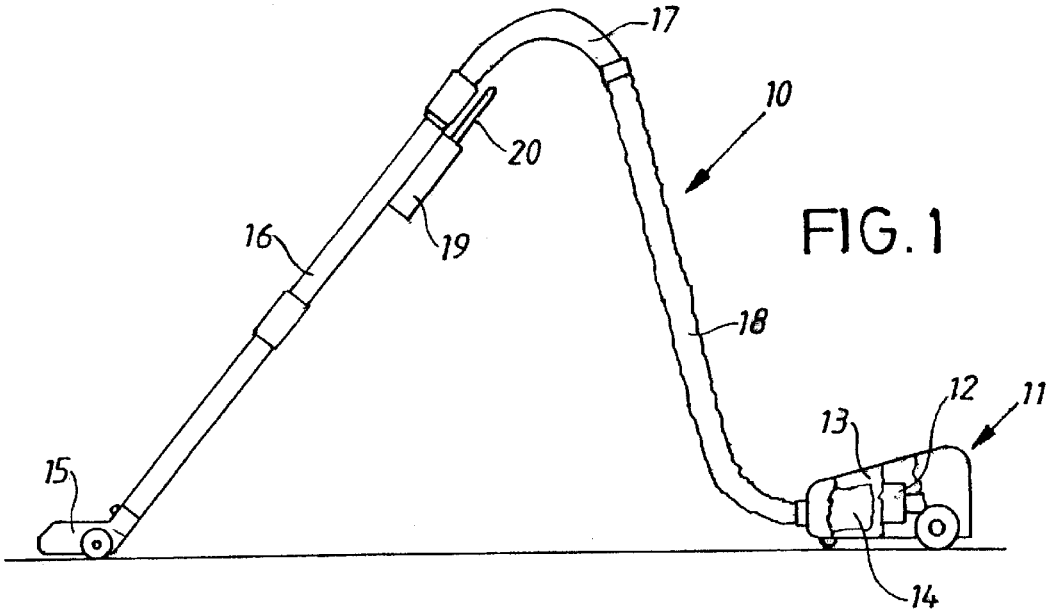
FIG. 1 is a schematic side view showing a vacuum cleaner provided with a device according to the invention; and, FIG. 2 is a vertical section through said device.

The vacuum cleaner 10 shown in FIG. 1 has a vacuum cleaner housing 11 with a vacuum source 12, preferably a motor-fan unit, communicating with a separation container

13. The separation container 13 surrounds an air permeable bag 14, a cyclone separator or the like in which the dust and the dirt particles are separated from the dust-laden air flow. The dust-laden air flow flows from a nozzle 15 via a tube shaft 16, a tube handle 17, and a hose 18 into the separation container 13. Thus, the last mentioned parts 15, 16, 17, 18 and 13 form an inlet channel for the dust laden air. The air passage after the motor-fan unit, as seen in the flow direction, forms an outlet channel for the cleaned air entering the atmosphere.

The tube shaft 16 supports a holder 19 for a feather-duster 20 close to the tube handle 17. The holder 19 preferably forms a cylindrical chamber 21 that, at its upper wall part, has several tangentially directed air inlets 22 and, at its lower wall part, additional air inlets 23. The holder 19 also has a closed bottom part 24 and a roof part 25 having a central opening 26 through which the feather-duster 20 can be inserted into the holder.

The holder 19 and the feather-duster 20 are preferably made of materials such that the flexible threads and/or fibers of the feather-duster are charged with static electricity when being rubbed against one another and the side walls of the holder.

Between the tube shaft 16 and the holder 19 there is an outlet 27 through which air can flow from the chamber 21 to the tube shaft 16. The outlet 27 is, during normal vacuum cleaning operation, closed by a cover 28 that is turnably supported by a hinge 29. The cover is connected to a flap 30 that, during normal vacuum cleaning operation, does not prevent air from flowing through the tube shaft 16. The cover 28 is under the influence of a spring 31 that biases the cover 28 toward a closed position. The cover also comprises an extending flange 32 to be acted on by the feather-duster.

The device operates in the following manner. During a normal vacuum cleaning operation the feather-duster is stored in the holder in a partly inserted position. In the partly inserted position the feather-duster 20 does not engage the flange 32. This means that the dust laden air can freely flow through the tube shaft 16 from the nozzle 15 to the vacuum source 12. When the operator comes to a place where the feather-duster 20 is to be used, the feather-duster is drawn out from the holder and the dusting operation is effected. Thereafter, the feather-duster is again inserted into the holder 19.

Figure 2:
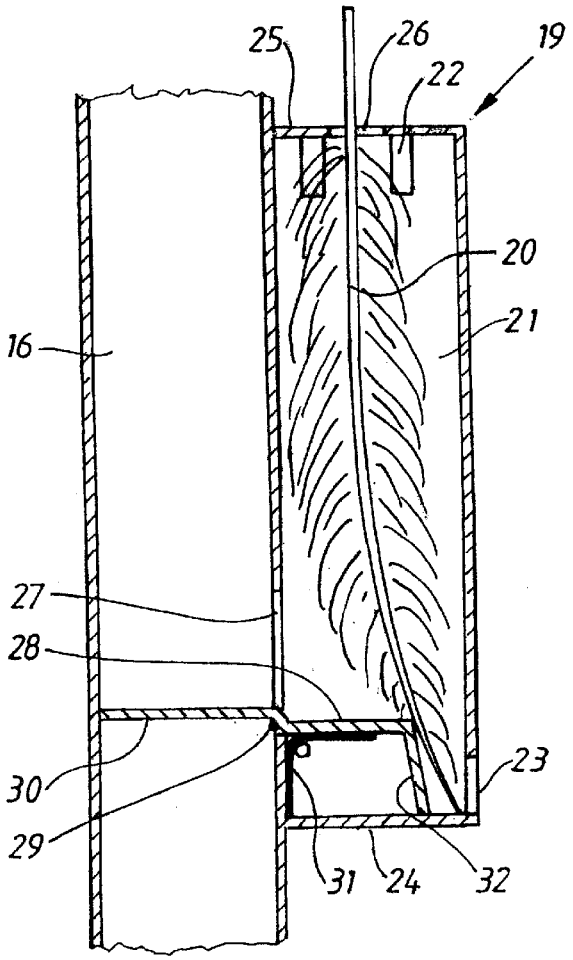

The operator may choose to insert the feather-duster partly into the holder, which means that the feather-duster will not be cleaned and vacuum cleaning can be made as before. Alternatively, the operator may choose to insert the feather-duster completely into the holder. If the feather-duster is inserted completely into the holder it will, during its movement, act on the flange 32 such that the cover 28 and hence the flap 30 is turned clockwise about the hinge 29 to the position shown in FIG. 2 in order to open the outlet 27. If the vacuum cleaner is now activated, air will be drawn in through the inlet 22 and 23, flow through the chamber 21, further through the outlet 27 to the upper part of the tube shaft 16, and then through the tube handle and the hose into the bag 14.

The air flowing through the chamber will thus remove the dust from the feather-duster and simultaneously shake the feather-duster with its flexible thin threads and/or fibers. Accordingly, the dust collected by the feather-duster is taken up by the air flow and is later separated in the bag 14. Simultaneously, the threads and/or fibers are charged electrostatically because they, when being shaken, are rubbed against the surrounding wall. The duster-feather can then be partly removed from the holder which means that the cover 28 is closed such that the air flow through the chamber ceases. Thereafter, the feather-duster is again ready to be used.

The threads and/or fibers of the feather-duster should be manufactured by a material that differ from the material of the surrounding wall. The choice of material is such that the different materials are heavily separated from one another in the so called triboelectrical serie in order to achieve a high static charging of the feather-duster.

Even if the embodiment describes a method for cleaning a feather-duster, the same method can be used for cleaning a micro fiber duster. Then it is, of course, suitable to adapt the holder 19, the chamber 21, and the opening 26 to the shape of the duster as well as providing the holder or the duster with means for securing the duster to the vacuum cleaner during the vacuum cleaning and charging operation.

The holder is preferably placed close to the hands of the operator but can, of course, be placed at a suitable location on the vacuum cleaner. With regard to the function of the valve, it can, instead, be activated by direct manual action or by other means. It is also possible to provide the vacuum cleaner with some kind of electrically or pneumatic driven means that can be activated in order to shake the duster or the feather-duster during the cleaning operation. It is also within the scope of the invention to use conventional electrically driven charging means for charging the feather-duster or the micro fiber duster with static electricity.

It should also be mentioned that even if the embodiment described above relates to so called canister vacuum cleaners it could as well be used for so called upright vacuum cleaners.

In case a feather-duster is used it is preferably provided with a telescopic shaft by means of which the length of the shaft can be adjusted such that it suits the actual use.

It is also possible to use the cylindrical chamber as a holder for the feather-duster or duster for so called cyclone vacuum cleaners, i.e. such vacuum cleaners in which the dust is separated from the air flow in a cylindrical chamber by means of cyclone effect, during the cleaning and/or charging stage.

What is claimed is:

1. A device for charging a duster with static electricity for use with a vacuum cleaner having a vacuum source connected to an inlet channel and an outlet channel for air flowing through the vacuum cleaner, the device comprising a duster and means for charging the duster with static electricity when said duster is placed in charging relationship therewith, said means for charging connected to one of the inlet or the outlet channels.

2. The device according to claim 1, wherein the duster is selected from the group consisting of feather dusters and micro fiber type dusters.

3. The device according to claim 1, further comprising a holder (19) for the duster.

4. The device according to claim 3, wherein the holder (19) is the charging means.

5. The device according to claim 4, wherein the holder (19) defines a chamber (21) in which at least a part of the duster is inserted and vibrated.

6. The device according to claim 3, wherein the holder (19) defines a chamber (21) in flow communication with the air flowing through at least one of said inlet channel and said outlet channel, into which at least a part of the duster is inserted and is subjected to vibrations.

7. The device according to claim 6, wherein the vibrations are achieved by means of at least a portion of the air flowing through at least one of said inlet channel and said outlet channel.

8. The device according to claim 7, wherein the chamber is provided with at least one air inlet (22, 23) and one air outlet (27), the air outlet being arranged to communicate with at least one of said inlet channel and said outlet channel.

9. The device according to claim 7, wherein the duster (20) is a feather duster having several thread shaped elements of a length such that, when air flows through the chamber, the thread shaped elements are in vibrating engagement with the walls of the chamber (21) to electrostatically charge the elements.

10. The device according to claim 6, wherein the chamber is provided with at least one air inlet (22, 23) and one air outlet (27), the air outlet being arranged to communicate with at least one of said inlet channel and said outlet channel.

11. The device according to claim 10, wherein the duster (20) is a feather duster having several thread shaped elements of a length such that, when air flows through the chamber, the thread shaped elements are in vibrating engagement with the walls of the chamber (21) to electrostatically charge the elements.

12. The device according to claim 6, wherein the duster (20) is a feather duster having several thread shaped elements of a length such that, when air flows through the chamber, the thread shaped elements are in vibrating engagement with the walls of the chamber (21) to electrostatically charge the elements.

13. The device according to claim 1 wherein said charging means is an electrically driven charger.

* * * * *